US008819974B2

(12) United States Patent
Noterman

(10) Patent No.: US 8,819,974 B2
(45) Date of Patent: Sep. 2, 2014

(54) PHOTO FRAMING TEMPLATE AND MOUNTING BRACKET ASSEMBLY

(71) Applicant: Christian Carter Noterman, Westminster, CA (US)

(72) Inventor: Christian Carter Noterman, Westminster, CA (US)

(73) Assignee: Knoll Oaks Holdings, LLC, Westlake Village, CA (US)

( * ) Notice: Subject to any disclaimer, the term of this patent is extended or adjusted under 35 U.S.C. 154(b) by 11 days.

(21) Appl. No.: 13/733,094

(22) Filed: Jan. 2, 2013

(65) Prior Publication Data

US 2013/0167418 A1 Jul. 4, 2013

Related U.S. Application Data

(60) Provisional application No. 61/582,466, filed on Jan. 2, 2012.

(51) Int. Cl.
*A47G 1/06* (2006.01)

(52) U.S. Cl.
USPC ..... 40/780; 40/782

(58) Field of Classification Search
USPC ..... 40/780, 782; 38/102.1, 102.91
See application file for complete search history.

(56) References Cited

U.S. PATENT DOCUMENTS

| | | | | |
|---|---|---|---|---|
| 3,336,689 | A * | 8/1967 | Miller | 40/782 |
| 5,090,835 | A * | 2/1992 | Cox | 403/294 |
| 5,579,595 | A * | 12/1996 | Dutton | 38/102.1 |
| 6,347,466 | B1 * | 2/2002 | Lackner et al. | 38/102.4 |
| 2005/0069673 | A1 * | 3/2005 | Chaimberg | 428/98 |
| 2010/0218404 | A1 * | 9/2010 | Vaz | 38/102.1 |

FOREIGN PATENT DOCUMENTS

WO WO 2010001178 A2 * 1/2010 ..... B44D 3/18

* cited by examiner

*Primary Examiner* — Gary Hoge
(74) *Attorney, Agent, or Firm* — Todd J. Langford; Eric A. Hanscom

(57) ABSTRACT

This invention relates to the general field of photo mounting, and more specifically toward a template and mounting assembly that can be used to effectively mount a photograph. The template has a basic design of a hard surface bordered by four open sections, which can be universally applied to a variety of different sizes and configurations of photographs. The mounting assembly includes four brackets that form the underlying frame of the mounted photograph.

17 Claims, 5 Drawing Sheets

PHOTO FRAMING TEMPLATE AND MOUNTING BRACKET ASSEMBLY

CROSS REFERENCE TO RELATED APPLICATIONS

This application claims the benefit of U.S. Provisional Patent App. No. 61/582,466 filed on Jan. 2, 2012, the entirety of which is incorporated by reference.

STATEMENT REGARDING FEDERALLY SPONSORED RESEARCH OR DEVELOPMENT

This invention was not federally sponsored.

BACKGROUND OF THE INVENTION

Field of the Invention:

This invention relates to the general field of photo mounting, and more specifically toward a template and mounting bracket assembly that can be used to effectively mount canvas artwork, such as a photograph printed on canvas material. The template has a basic design of a hard surface bordered by four open sections, which can be universally applied to a variety of different sizes and configurations of canvas artwork. In a particular embodiment, each template is sized to one of the average sizes and shapes of photographs thereby producing a consistent product in an efficient manner. Rather than measuring, trying to make perfect cuts, and relying upon a frame that may have inconsistencies, a user of this invention will produce the same quality of mounted artwork with each use. While the invention was originally designed for the mounting of canvas photographs, it can just as easily be used with other artwork affixed to other similar mediums. Also, although the invention is particularly well-suited to a commercial photo printing and retail mounting settings that print and mount large size canvas photographs, the invention may also be utilized by amateurs to mount their photographs themselves and produce professional quality results.

To this end, a template is provided with a center backing portion, four cutouts, which are rectangular holes along the four sides of the backing bordered by defining edges on the outer portions, and four corners, which are solid sections connected to the backing by a small section referred to as a connector. The connector is protected by a handle, which serves not only to protect the connector against being broken, but also allows a user of the invention to pick the template up easily once it is no longer needed on a photo.

A mounting assembly is also provided. The mounting assembly was designed with the same theory in mind that served as the inspiration for the template: create a product that is easily used by professionals and amateurs alike, where the user can consistently produce professional-quality mounted photographs. Each mounting assembly includes multiple brackets that each have a bottom surface, two 45 degree angled ends, a top surface and two side surfaces. The bottom surface, angled ends, and one of the side surfaces are at least partially coated with an adhesive and covered by a removable, non-tacky protective sheet or liner. Each bracket also has two sockets, one on either end, into which a dovetail joint, or joiner, can be inserted. For a square photograph, four brackets of the same size are used; for a rectangular photograph, two long brackets and two short brackets are used.

The mounting of photographs dates back to the late 1800's, when photograph paper first was used. Photograph mounting was not a new science, as the method of mounting paintings was well known in the art by that time. However, as photographs got larger and larger, the centuries-old method of stretching the canvas or photograph paper over a wood or metal frame was not effective, as the quality of the result depended as much on the skill and patience of the person mounting the photograph as it did on the materials used.

With the advent of digital photography in the 1980's, and particularly with the invention and refinement of processes in the late 1990's and early 2000's that allowed for inexpensive cameras with high-resolution capabilities to be available to the general public, the industry of mounting large size photographs became a major industry. Today, millions of dollars each year are spent by professional and amateur photographers on mounted photographs.

One of the more popular materials or mediums upon which a photograph is enlarged is canvas. While not providing as smooth a surface as glossy photographic paper, canvas is easy to stretch over a frame and therefore can hold its shape better than some photographic papers. However, it is difficult to stretch a canvas photograph over a frame such that the pull is evenly distributed. Frames may also have variations and irregularities in the various members and the connections on the joints, such that even if a mounter does a professional job, his or her job is only as good as the underlying frame. Furthermore, many prefer the artistic look of a photograph printed on canvas.

In addition, some of the tools and materials used in traditional mounting can be both expensive and hazardous. For example, hammers, staple guns, stretching pliers and nails all can be dangerous if used by professional mounters who are careless or amateurs who don't know what they are doing. The glue that many mounting operations use can also be toxic and the fumes are dangerous if inhaled. Waste is also an issue, as retail associates can leave the cap off, spill the bottle containing the glue or even lose the bottle of glue.

Finally, traditional methods of mounting require a considerable amount of skill, making the creation of a professional-appearing mounted photograph a task quite difficult for the untrained user. For example, stretching a canvas photograph the proper amount to achieve a tight fit and yet not too much to rip or distort the canvas is not an easy art to learn.

Thus there has existed a long-felt need for a device for preparing a photograph for mounting and to actually mount the photograph to a frame in an eye-pleasing and consistent manner.

SUMMARY OF THE INVENTION

The current invention provides just such a solution by having a template that can be used to prepare a photograph for mounting, and by providing a bracket that can be used with the template to produce consistently high-quality mounted photographs. The four brackets of the mounting assembly are used for the underlying frame of the mounted photograph.

It is a principal object of the invention to provide a template for use in cutting a canvas photograph into the proper shape for easy mounting.

It is another object of the invention to provide a mounting bracket that fits into the cutouts in the template and adheres to the back of the canvas photograph.

It is yet another object of the invention to provide a means, through dovetail sockets and joiners, to attach the ends of each bracket to the adjacent bracket at a 45 degree angle.

It is a final object of this invention to provide an easy-to-use method by which a canvas photograph can be mounted quickly, efficiency, and with high quality results time after time.

In a particular embodiment, the current invention is a photo framing template and mounting bracket system, comprising a template, where the template comprises a center portion, four cutouts, four connectors, and four handles, where the four cutouts comprise rectangular openings in the template bordered on an inner side by the center portion, bordered on an outer side by an outer edge, and bordered on top and bottom sides by two corners, where the four connectors comprise thin sections of material that connect the corner to the center portion, where the four handles also connect the center portion to a corner; and a mounting assembly, where the mounting assembly comprises four brackets, where each bracket comprises a top surface, a bottom surface, two ends, an inner surface and an outer surface, where the ends are angled at 45 degrees from the top surface and the bottom surface, and where at least one of the top surface, bottom surface, two ends, inner surface and outer surface is coated on at least a portion with an adhesive substance, where each bracket further comprises two dovetail sockets, and where the mounting assembly additionally comprises a removable, non-tacky protective liner.

In another embodiment, the current invention is a system for framing a canvas material comprising a template and a mounting assembly; where the template comprises a center portion, four cutouts and four corners, where each corner is adjacent to two cutouts, where each cutout is adjacent to two corners; where the mounting assembly comprises four brackets, where each bracket has two sides, two angled ends, a top and a bottom, where one of the two sides comprises an adhesive, where each of the angled ends comprises an adhesive and a socket; and where the bottom surface comprises an adhesive.

In yet another embodiment, the current invention is a mounting assembly comprising four brackets, where each bracket has two sides, two angled ends, a top and a bottom, where one of the two sides comprises an adhesive, where each of the angled ends comprises an adhesive and a socket; and where the bottom surface comprises an adhesive, where the angled ends of each bracket are at a forty-five (45) degree angle.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figures 1, 2:
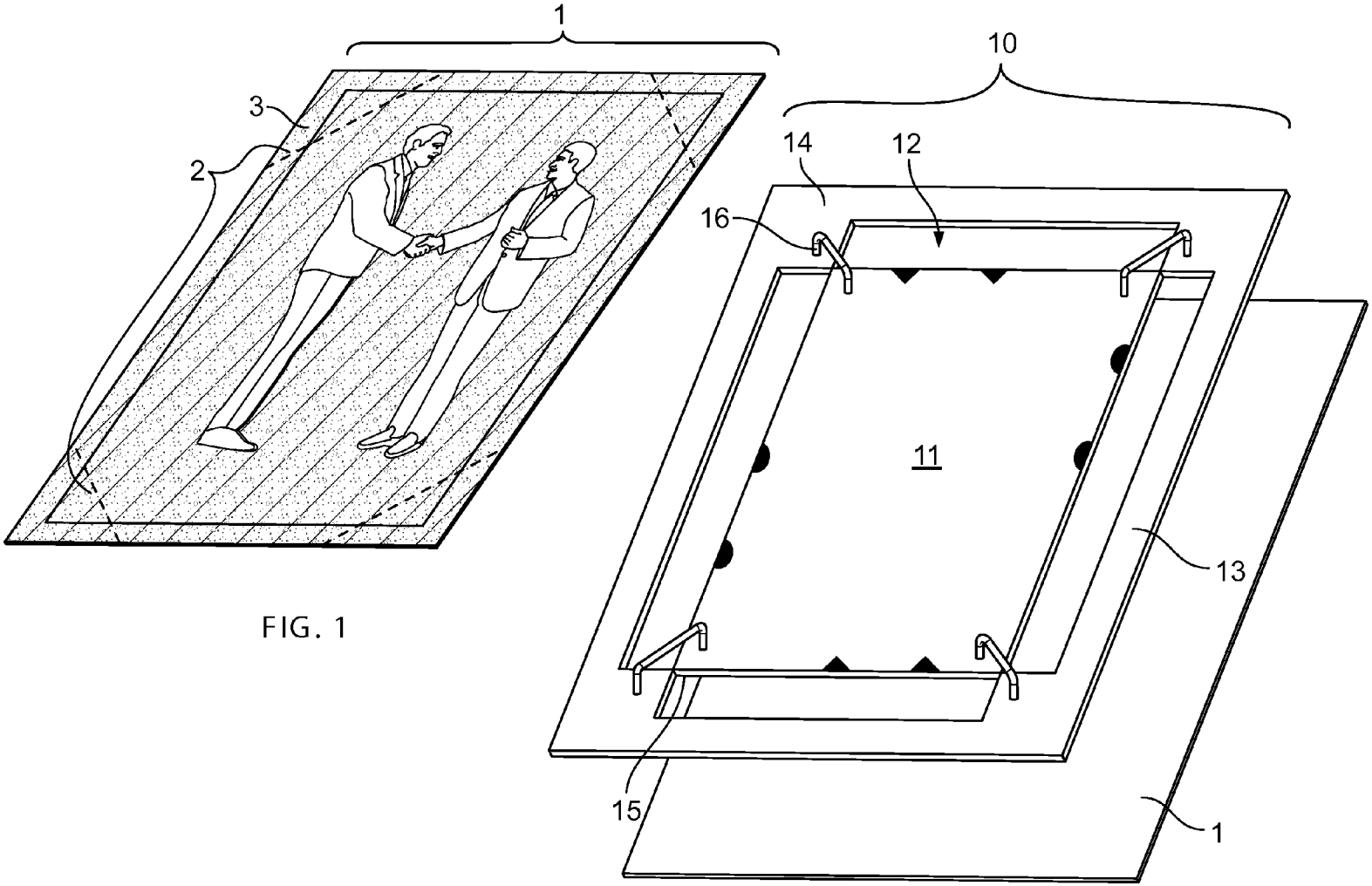
FIG. 1 is a perspective view of a canvas photograph after it has been trimmed to match the dimensions of the template and prior to its mounting to the brackets, with cut lines shown.
FIG. 2 is a perspective view of the template being laid upon the back of the canvas photograph, showing the various parts of the template.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a perspective view of a canvas photograph (1) after its trimming for the template and prior to mounting it to the brackets, with cut lines (2) shown, illustrating the location at which the corners (3) are removed. Cut line (2) is located in the same place on every photo. The initial trimming is done by cutting the outer portions of the canvas to match the dimensions of the template to ensure that the image, cut line (2) and the white area around the printed image are all aligned properly. In a particular embodiment, the portions to cut from the canvas to match the template are demarcated by lines that are printed with the photograph onto the canvas. Additionally, the cut lines (2) may be printed with the photograph as well. This is the extent of the preparatory work to be done on the canvas photograph prior to beginning the mounting process.

FIG. 2 is a perspective view of the template (generally referred to by reference number 10) being laid upon the back of the canvas photograph (1), showing the various parts of the template. The template (10) has a center portion (11), which is a large, solid section in the middle of the template. On the edges of the center portion (11) are cutouts (12), which are four open rectangular areas within the template. The length and shape of the cutouts (12) depend on the size and shape of the brackets (illustrated later in FIG. 3 and on), and on the desired finished shape of the mounted photo (illustrated later in FIG. 9). For a square mounted photograph, the cutouts would be the same size; for a rectangular mounting, there would be two "long" cutouts and two "short" cutouts. The cutouts (12) border four corners (14), which are solid squares that are connected to the center portion (11) by connecting portions (15), which are thin strips of material that provide a connection and some support to the corners from the center portion. Additional support for the corner is provided by a handle (16) that not only supports the connector (15), but also provides and convenient means by which the template can be raised or lowered onto the canvas photograph. Each cutout (12) is defined on its inner surface by the center portion (11), two corners (14), two connecting portions (15) and an outer edge (13), where the cutout provides an opening into which a bracket (discussed later) is inserted.

Figure 3:
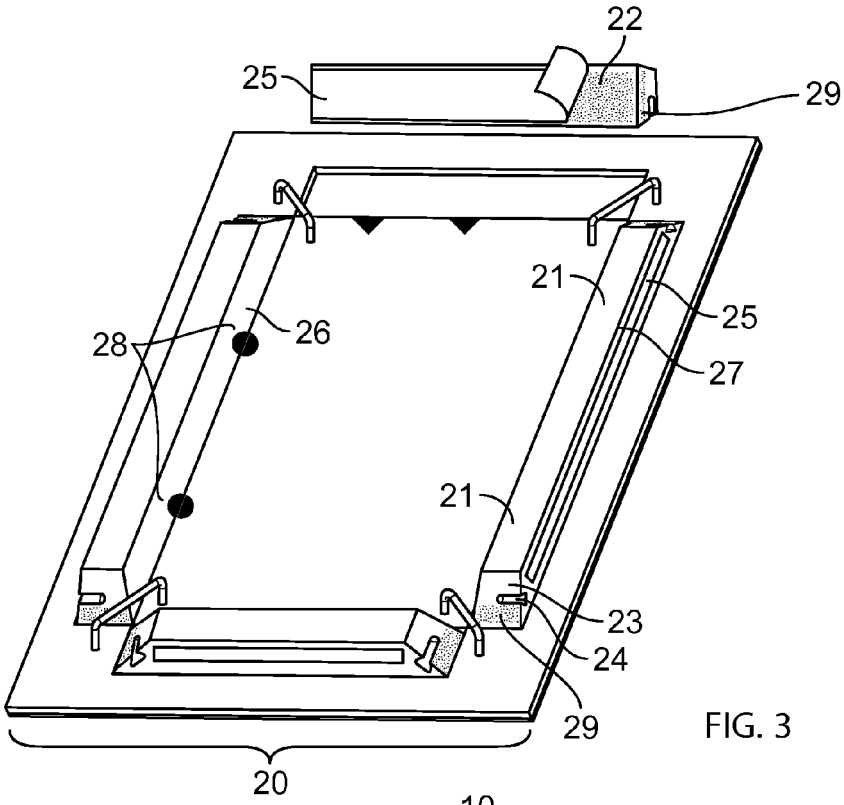
FIG. 3 is a perspective view of four brackets being attached to the back of the canvas photograph through the open cutouts in the template.

FIG. 3 is a perspective view of four brackets (20) being attached to the back of the canvas photograph through the open cutouts in the template. Each bracket (generally referred to by reference number 20) has a bottom (22) which has an adhesive surface that is protected by a removable, non-tacky protective sheet or liner (25), two 45 degree angled ends (23), a top surface (21) and two side surfaces: inner side (26) and outer side (27). The top surface (21) has a contrasting first shape (28), which aids the user in aligning each bracket, described in more detail below. Both the ends (23) and the outer side (27) also have an adhesive surface that is protected by a removable, non-tacky protective sheet or liner. Adhesive (29) is shown on the bottom part of the end (23) of the bracket (21). Each bracket includes two sockets (24), which in a particular embodiment of the invention are dovetail sockets, one on either end, into which a dovetail joint, or joiner (described below), can be inserted. For a square photograph, four brackets of the same size are used; for a rectangular photograph, two long brackets and two short brackets are used.

A particular embodiment of the current invention has an arrow as the first shape (28) that indicates an orientation or direction in which the bracket is to be placed within the template. In another embodiment, first shape (28) includes half of a shape, such as half of a circle or a triangle, and the template (10) includes the other half of that shape such that when the bracket and template or configured together correctly, the completed shape is displayed to the user. For example, half of the arrow appears on the top surface (21) of the bracket 20 and the other half appears on the template (10). The shape should be a contrasting color from the bracket (background) so that the shape is readily discernable by a user. Such a design simplifies the placement of each bracket.

To prepare the photograph for mounting, the removable, non-tacky protective liner (25) is removed from the bottom of each bracket, and then each bracket is placed through its corresponding cutout in the template such that its tacky surface adheres to the canvas photograph. Once all four brackets are attached to the back of the canvas photograph, there is no further need for the template.

Figure 4:
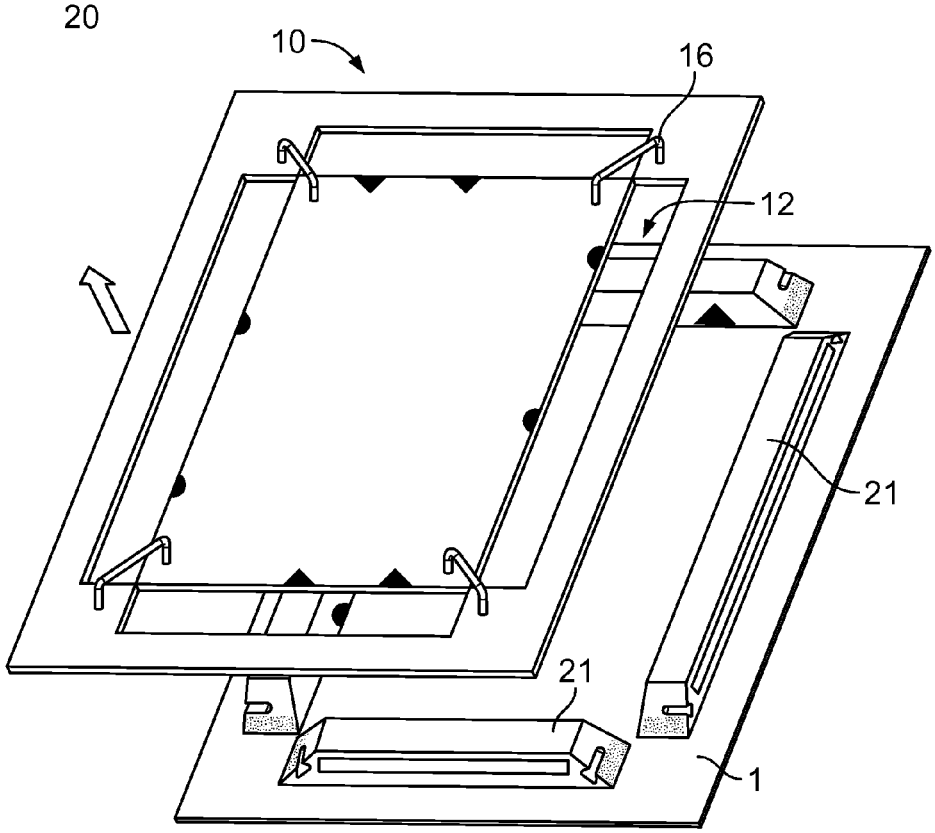
FIG. 4 is a perspective view of the brackets in place on the back of the canvas photograph and the template being removed.

FIG. 4 is a perspective view of the brackets (21) in place on the back of the canvas photograph (1) and the template (10) being removed. A user can easily grasp the handles (16) and lift the template (10) off the canvas photograph after the brackets (20) have been secured to the back of the canvas photograph (1). Note how the brackets (20) are always secured in identical positions on the back of the photograph as the template's cutouts (12) can allow the bracket to contact the photograph only through the cutout, thereby ensuring a consistent final product.

Figure 5:
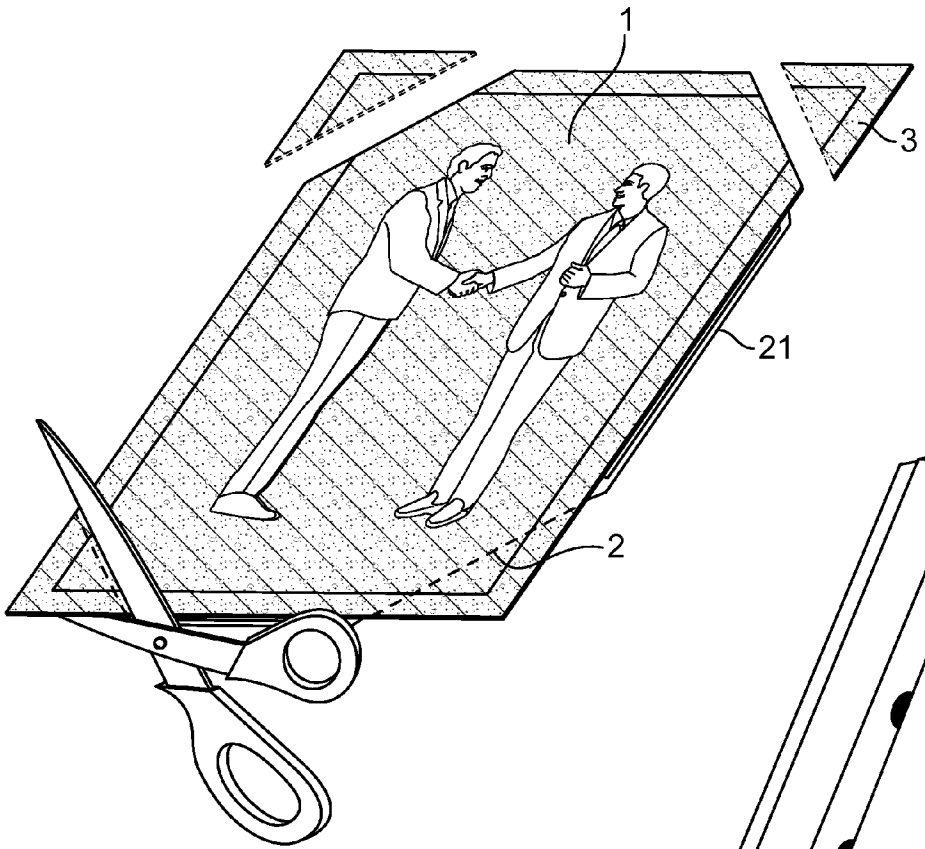
FIG. 5 is a perspective view of the canvas photograph, with brackets attached, after having been turned over with a 45 degree section being cut off each corner of the canvas photograph.

FIG. 5 is a perspective view of the canvas photograph (1), with brackets (20) attached, after having been turned over. A 45-degree section (3) is cut off each corner of the canvas photograph along cut lines (2).

Figure 6:
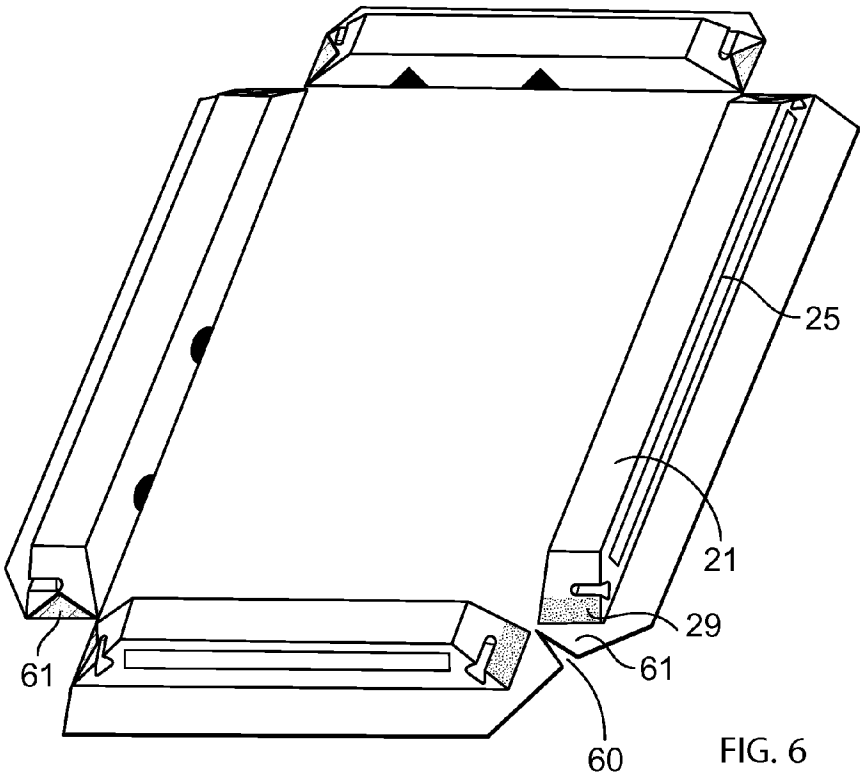
FIG. 6 is a perspective view of the brackets in place on the back of the canvas photograph and the canvas photograph being folded up on the ends of each bracket.

FIG. 6 is a perspective view of the brackets (20) in place on the back of the canvas photograph (1) and the canvas photograph being folded up on the ends of each bracket. The removable, non-tacky protective liner (25) is then removed from the ends of each bracket (if not done so already) and a small cut (60) is made into the four remaining corners of the canvas photograph (known as a "miter out"). The resulting edge sections (61) are then pulled upward and attached to the adhesive surfaces on the edges of the brackets.

Figures 7, 8:
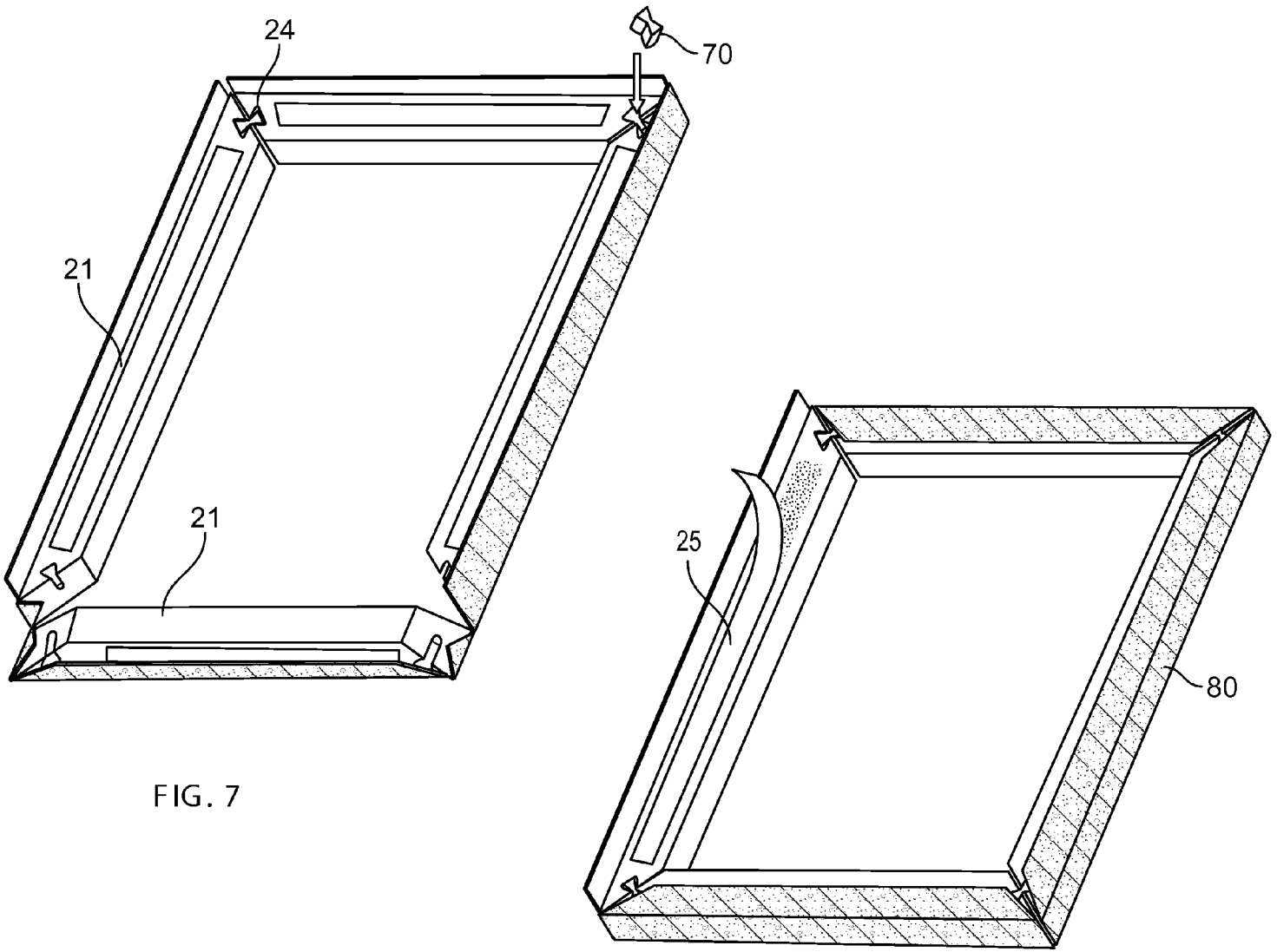
FIG. 7 is a perspective view of the brackets after they are folded inward, such that the 45 degree ends of each bracket can be joined and secured to the 45 degree ends of adjacent brackets through the use of dovetail joints in the ends of each bracket and joiners.
FIG. 8 is a perspective view of a strip of protective covering being removed, such that the sides of the canvas photograph can be stretched across the back of the brackets and attached to the brackets.

FIG. 7 is a perspective view of the brackets (20) after they are folded inward, such that the 45 degree ends of each bracket mate together. The 45 degree ends of adjacent brackets are secured together by using joiners (70) inserted into dovetail sockets (24) in the ends of each bracket. In other words, because the location of each bracket (20) on the back of the canvas photograph has been predetermined exactly by the cutouts in the template, each bracket is "rolled inward" such that the 45 degree ends align with each other and the dovetail sockets (24) align with the mating dovetail socket (24) on the adjacent bracket. A joiner (70) is then inserted in each dovetail socket to secure the brackets to each adjacent bracket. This figure also shows edge section (61) folded onto the end of one of the brackets (20).

FIG. 8 is a perspective view showing the final steps of framing a canvas photographer. The strip of protective liner (25) is removed to reveal and adhesive thereunder. The sides (80) of the canvas photograph are then pulled up and stretched across the back of the brackets and secured to the brackets using the adhesive on the outer side. Once all four sides (80) have been attached, the process of mounting the photograph is complete.

Figure 9:
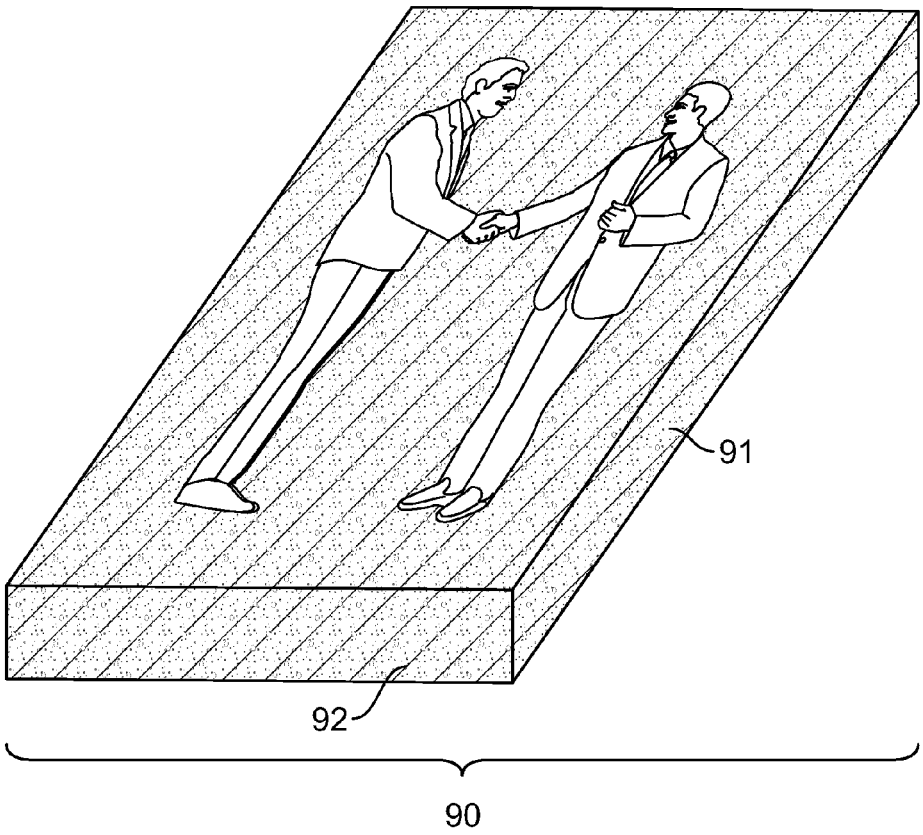
FIG. 9 is a perspective view of the final mounted photograph.

FIG. 9 is a perspective view of the final mounted photograph, generally referred to by reference number 90. This photo also illustrates how the sides (91) and top/bottom portions (92) of the mounted photograph carry over the photograph this is displayed, such that there is no need for any decorative frame to cover up any unsightly side portions.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A photo framing template and mounting bracket system, comprising a template, where the template comprises a center portion, four cutouts, four connectors, and four handles, where the four cutouts comprise rectangular openings in the template bordered on an inner side by the center portion, bordered on an outer side by an outer edge, and bordered on top and bottom sides by two corners, where the four connectors comprise thin sections of material that connect the corner to the center portion, where the four handles also connect the center portion to a corner; and, a mounting assembly, where the mounting assembly comprises four brackets, where each bracket comprises a top surface, a bottom surface, two ends, an inner surface and an outer surface, where the ends are angled at 45 degrees from the top surface and the bottom surface, and where at least one of the top surface, bottom surface, two ends, inner surface and outer surface is coated on at least a portion with an adhesive substance, where each bracket further comprises two dovetail sockets, and where the mounting assembly additionally comprises a removable, non-tacky protective liner.

2. The system of claim 1, where the brackets are all of the same length and can be used to create a square mounted photograph.

3. The system of claim 1, where the brackets are of two different lengths, with two brackets of a length longer than that of two shorter brackets, where the four brackets can be used to create a rectangular mounted photograph.

4. The system of claim 1, where each end, each bottom surface and each outer surface of each bracket of the mounting assembly is coated on at least a portion with an adhesive substance.

5. The system of claim 1, where each bracket additionally comprises a contrasting shape on its top surface.

6. The system of claim 5, wherein the center portion of the template comprises four contrasting shapes, where the contrasting shapes of the center portion of the template align with the contrasting shapes of the top surface of each bracket when the brackets are properly placed within the cutouts of the template.

7. A system for framing a canvas material comprising
a template and a mounting assembly;
where the template comprises a center portion, four cutouts and four corners, where each corner is adjacent to two cutouts, where each cutout is adjacent to two corners;
where the mounting assembly comprises four brackets, where each bracket has two sides, two angled ends, a top and a bottom, where one of the two sides comprises an adhesive, where each of the angled ends comprises an adhesive and a socket; and where the bottom surface comprises an adhesive.

8. The system of claim 7, wherein the template further comprises four handles, where each handle is secured to one of the four corners and the center portion.

9. The system of claim 7, wherein the mounting assembly further comprises four joiners, where each joiner mates with the socket of two adjacent brackets.

10. The system of claim 7, wherein the socket of each end of each bracket is a dovetail socket.

11. The system of claim 7, wherein the angled ends of each bracket are at a forty-five (45) degree angle.

12. The system of claim 7, wherein the four brackets each have the same length, where the length of a bracket is the distance between the two ends of the bracket.

13. The system of claim 7, wherein two of the four brackets have a length that is greater than the length of the other two brackets, where the length of a bracket is the distance between the two ends of the bracket.

14. The system of claim 7, wherein each bracket of the mounting assembly further comprises a protective liner.

15. The system of claim 14, wherein the protective liner covers the adhesive on the bottom surface of the bracket.

16. The system of claim 14, wherein the protective liner covers the adhesive on an end of the bracket.

17. The system of claim 14, wherein the protective liner covers the adhesive on one of the sides of the bracket.

* * * * *